US007392921B1

(12) United States Patent
McKenzie

(10) Patent No.: US 7,392,921 B1
(45) Date of Patent: Jul. 1, 2008

(54) TRANSPORTABLE PAPER TOWEL DISPENSER

(75) Inventor: Rebecca Anne McKenzie, Glenwood Springs, CO (US)

(73) Assignee: Rebecca McKenzie, Glenwood Springs, CO (US)

( * ) Notice: Subject to any disclaimer, the term of this patent is extended or adjusted under 35 U.S.C. 154(b) by 426 days.

(21) Appl. No.: 10/947,120

(22) Filed: Sep. 22, 2004

Related U.S. Application Data

(63) Continuation-in-part of application No. 10/151,375, filed on May 20, 2002, now Pat. No. 6,824,031.

(51) Int. Cl.
*A45F 5/00* (2006.01)

(52) U.S. Cl. ..... 224/666; 224/904; 224/270

(58) Field of Classification Search ..... 224/666, 224/667, 270, 271; 242/588.1, 586, 599
See application file for complete search history.

(56) References Cited

U.S. PATENT DOCUMENTS

| | | | | | |
|---|---|---|---|---|---|
| 462,310 | A | * | 11/1891 | Gardner | 242/422.5 |
| 833,238 | A | * | 10/1906 | Pitschke | 242/422.4 |
| 1,069,106 | A | | 8/1913 | Buhl | |
| 1,092,792 | A | | 4/1914 | Hemstreet | |
| 1,554,082 | A | | 9/1925 | Gierauld | |
| 1,704,614 | A | | 3/1929 | Johnston | |
| 3,258,220 | A | | 6/1966 | Munger | |
| 3,721,395 | A | | 3/1973 | Snipes | |
| 4,071,200 | A | * | 1/1978 | Stone | 242/564 |
| 4,390,096 | A | | 6/1983 | Goldenberg | |
| 4,609,485 | A | | 9/1986 | Kitano et al. | |
| 4,896,806 | A | | 1/1990 | Sanchez, Jr. | |
| 5,941,438 | A | | 8/1999 | Price | |
| 6,173,839 | B1 | | 1/2001 | Dieter et al. | |
| 6,216,920 | B1 | | 4/2001 | Baggett | |
| 6,216,978 | B1 | | 4/2001 | Rodriguez | |
| 6,267,316 | B1 | | 7/2001 | Cross | |
| 6,460,799 | B1 | * | 10/2002 | Ryan | 242/594.5 |
| 6,824,031 | B2 | * | 11/2004 | McKenzie | 224/666 |

* cited by examiner

*Primary Examiner*—Nathan J Newhouse
*Assistant Examiner*—Margart Olson

(57) ABSTRACT

An improved transportable paper towel dispenser intended to be worn on the person of the user for the purpose of having a constant access to a roll of paper towels when cleaning. The transport assembly supports an adjustable tension mechanism and a dowel system bearing a roll of paper towels. The transport assembly, tension mechanism and dowel system are interconnected by pulley systems that control the pressure exerted upon the roll of paper towels, thus providing controlled dispensing of the entire roll of paper towels and to retard unraveling. And further adjusting to raise or lower the angle of the paper towel roll.

7 Claims, 5 Drawing Sheets

TRANSPORTABLE PAPER TOWEL DISPENSER

CROSS-REFERENCE TO RELATED APPLICATIONS

This is a continuation in part of application Ser. No. 10/151,375 filed May 20, 2002 now Pat. No. 6,824,031, Filed May 20, 2002 granted Nov. 30, 2004.

FEDERALLY SPONSORED RESEARCH

Not applicable

SEQUENCE LISTING OR PROGRAM

Not applicable

BACKGROUND OF THE INVENTION

1. Field of the Invention

This invention relates to paper towel holders, specifically an improved transportable paper towel dispenser intended to be worn on the person of the user for the purpose of providing instant access to a roll of paper towels when cleaning. My newly designed Transportable Paper Towel Dispenser functions in a similar manner to my Paper Towel Harness (parent application Ser. No. 10/151,375 filed May 20, 2002) having new and improved features resulting in optimum performance.

2. Background—Description of Prior Art

Paper towel holders are traditionally mounted to flat, stationary surfaces such as walls, cabinets etc. Paper towel holders are usually installed within a work area such as a kitchen or laundry room where they are the most utilized. When needed in other areas, the user will typically tear off the number of sheets anticipated for the task at hand. Or if the cleaning or drying task is extensive, one typically procures a new roll of paper towels and carries it to the cleaning area.

Because a roll of paper towels is cumbersome and unwieldy, it is usually carried separately from other cleaning supplies. It is often misplaced or left behind when the user moves on to another cleaning task. Time and motion are often wasted by the effort expended by just trying to keep track of a loose roll of paper towels.

The paper towel is an indispensable item to the professional cleaning person, as well as to most homemakers. Accordingly, there is a need for a device that provides continual, instant access to paper towels whenever or wherever they are needed.

BACKGROUND OF THE INVENTION—OBJECTS AND ADVANTAGES

In accordance with the preferred embodiment of the present invention, a transportable paper towel dispensing device is disclosed. Several advantages of my parent invention and my newly designed Transportable Paper Towel Harness thereof are hereby disclosed as:

(a) to provide continual access to a source of paper towels when cleaning.

(b) to provide a convenient transport of a roll of paper towels while moving to and from, or around a cleaning area.

(c) to provide an efficient means of dispensing the exact amount of paper towels as needed, when needed.

(d) to provide a transportable paper towel dispenser that secures the roll of paper towels snugly in order to discourage unraveling during their transport.

(e) to provide an awareness of the whereabouts of the paper towel roll at all times.

My new and improved Transportable Paper Towel Dispenser comprises a transport assembly, an improved tension mechanism that has been redesigned over may parent paper towel dispenser for better control and manipulation of the roll of paper towels and an improved dowel system designed for added control and the prevention of unraveling. These components are interconnected with newly designed adjustable pulley systems.

My Transportable Paper Towel Dispenser has been designed with two transport assembly options: In the preferred embodiment, my primary transport assembly comprises an adjustable belt strap transport assembly having adjustable pulley systems that interconnect the belt to my new and improved tension mechanism and the dowel system. The adjustable belt strap transport assembly is long enough to be worn loosely around a user's waist, allowing the paper towel roll to be easily shifted to the front, side or back of the user's body. Thus, when not in use, the paper towels are conveniently and easily moved out of the way, to the side or the back. The belt strap assembly can even be worn over the shoulder.

A second transport assembly option comprises a clip-on bar transport assembly that bears the same improved tension mechanism and dowel system interconnected by pulleys as described above. The clip-on bar transport assembly simply clips to a user's utility belt, pants belt, belt loop, pocket or any other object such as the cleaning supply basket, vacuum cleaner furniture etc.

My Transportable Paper Towel Dispenser features a new and improved, tension mechanism that is attached to the belt strap transport assembly, or optionally to the clip-on bar transport assembly, and to the dowel system by means of pulley systems. My new and improved tension mechanism features a newly designed tension tube that incorporates strategically placed foam (or equivalent) rollers on the outside circumference surface of the tension tube in order to more efficiently control the pressure exerted on to the paper towel roll and to further discourage unraveling.

My Transportable Paper Towel Dispenser features a new and improved dowel system designed with the intention to automatically fit the dowel size to the inner girth of a roll of paper towels. The dowel system interconnects with both the transport assembly (belt or clip-on bar) and the tension mechanism by means of elasticized pulley systems.

Further, my new and improved Transportable Paper Towel dispenser incorporates three separate pulley systems that interconnect the transport assembly (belt or clip-on bar), the tension mechanism and the dowel system. These pulley systems allow the user to raise or lower the dowel system, or the tension mechanism and to adjust the pressure or tension applied to a roll of paper towels.

My Transportable Paper Towel Dispenser is lightweight and comfortable to wear. It is flexible and is easy to maneuver and reposition on the person of the user, which is a desirable feature in commercial cleaning where the user is moving quickly around furnishings, machinery etc. My invention clearly saves time and motion. And saved time and motion mean increased productivity and profits on the commercial cleaning front.

SUMMARY

In accordance with the present invention, an Transportable Paper Towel Dispenser, having a choice of two transport assemblies. Each having adjustable pulley systems that interconnectably anchor my improved tension mechanism and dowel system to either an adjustable belt strap transport assembly or to a clip-on bar transport assembly. The tension mechanism subsequently releasably connects to the improved dowel system. My new tension mechanism effectively controls the pressure asserted upon a roll of paper towels that are carried on a new and improved dowel system designed to snugly secure the paper towel roll from within the towel roll core. The dowel adjusts to the precise girth of the paper towel roll core as the paper towels are dispensed. These new features allow controlled dispensing of the paper towels right down to the end of the roll, and the added tension control discourages unraveling.

DRAWINGS—FIGURES

In the drawings, closely related figures have the same number but different alphabetic suffixes.

DRAWING—REFERENCE NUMERALS

Figure 1A:
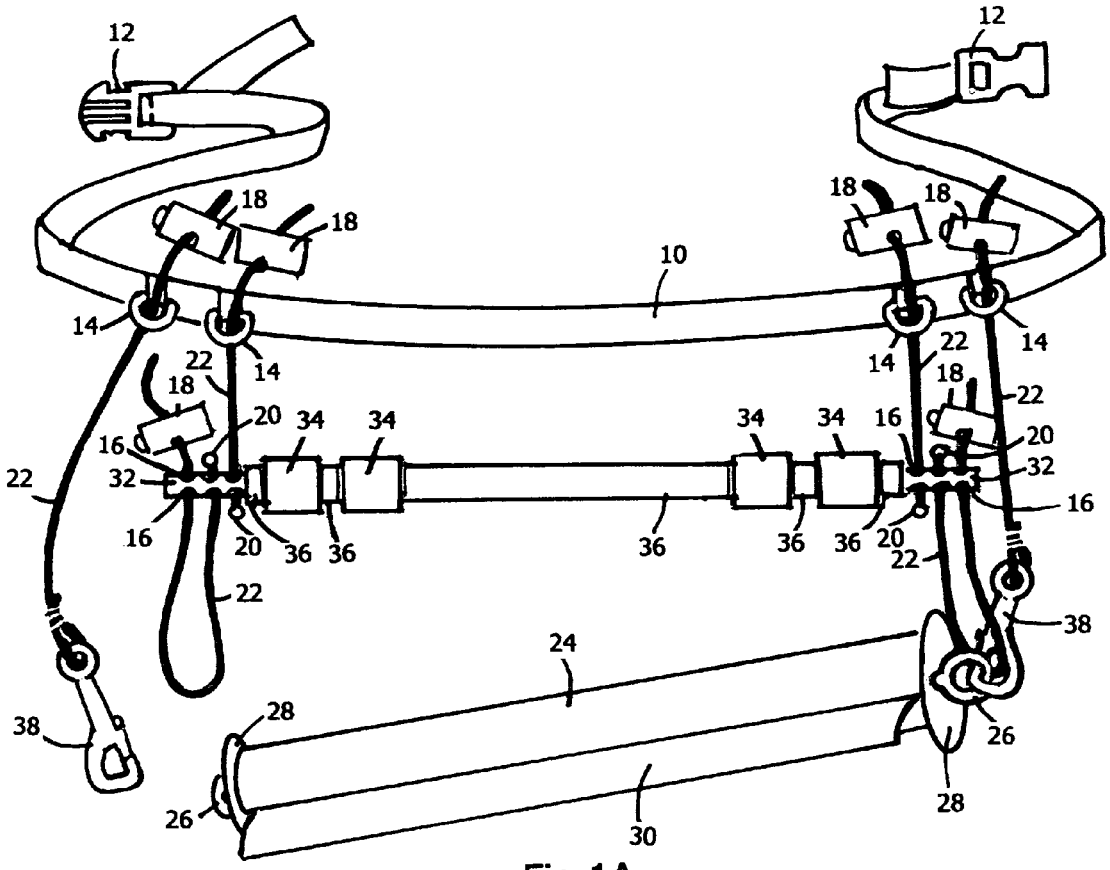
FIGS. 1A to 1B shows the preferred embodiment of my improved Transportable Paper Towel Dispenser featuring an adjustable belt strap transport assembly.

10 web strapping
12 belt fastener
14 D-ring
16 anchor port
18 cord lock
20 cord anchor
22 pulley cord
24 dowel
26 dowel eye aperture
28 dowel lip
30 dowel flange
31 foam flange liner
32 tension tube
34 tension tube rollers
36 tension tube spacers
38 bolt snap
40 clip-on bar
42 bar clip

DETAILED DESCRIPTION—FIGS. 1A-5C PREFERRED EMBODIMENT

Figure 1B:
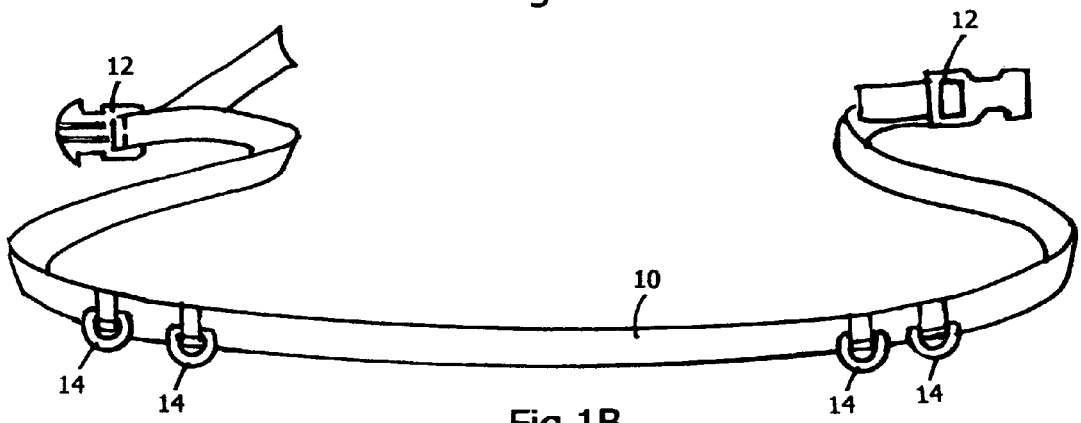

FIG. 1A shows a preferred embodiment of my new and improved transportable paper towel dispenser featuring an adjustable belt transport assembly that bears a tension mechanism and a dowel system. The belt transport assembly, comprising an adjustable belt, a tension mechanism and a dowel system that are interconnected by three pulley systems. FIG. 1B shows a detailed portion of an adjustable belt transport system that is comprised of a generous length of web strapping 10, a belt fastener 12, and two D-rings 14 (or equivalent anchor ports 16) whereby the two upper pulley systems subsequently connect the tension mechanism and the dowel system to the adjustable belt transport system.

Figure 2A:
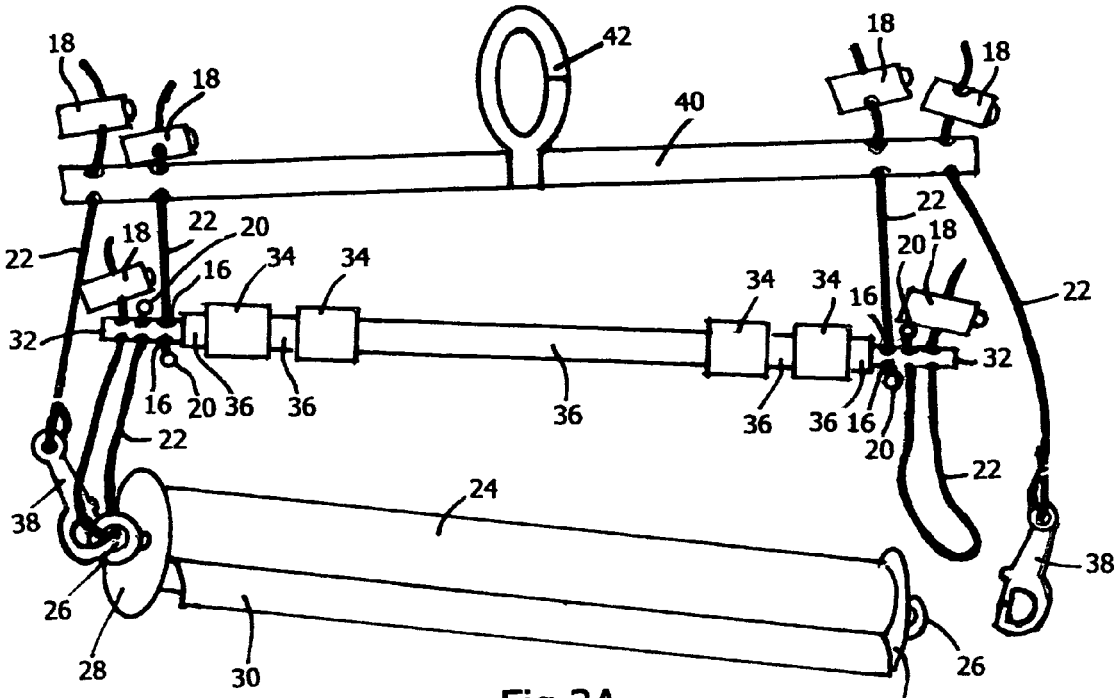
FIGS. 2A to 2B show various aspects and components of my improved Transportable Paper Towel Dispenser featuring an alternative clip-on bar transport assembly.
Figure 2B:
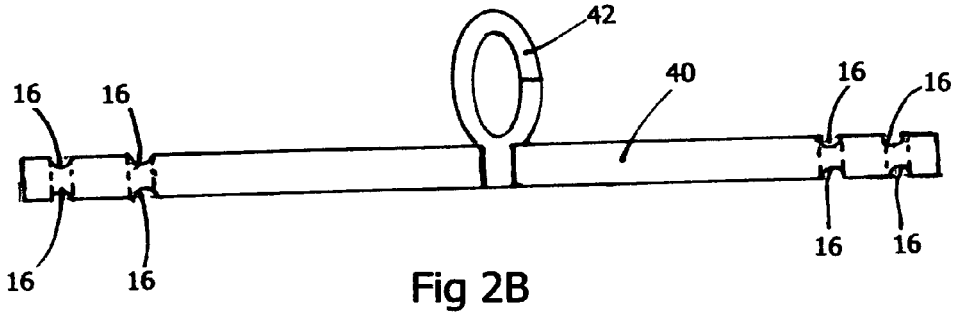

FIG. 2A shows my new Transportable Paper Towel Dispenser featuring an optional clip-on bar transport assembly bearing the same tension mechanism and a dowel system, interconnected by three pulley systems, in the same manner as described above. FIG. 2B shows a detailed portion of a clip-on bar transport assembly comprising a clip-on transport bar 40 with a bar clip 42, and anchor ports 16 whereby the clip-on bar assembly connects to the tension mechanism and a dowel system.

Figure 3A:
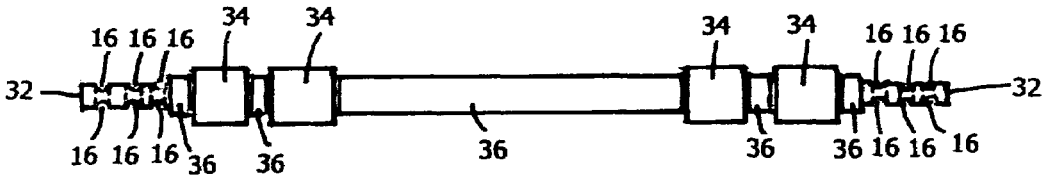
FIGS. 3A to 3C shows various aspects and components of an improved tension mechanism assembly and its parts.
Figure 3B:
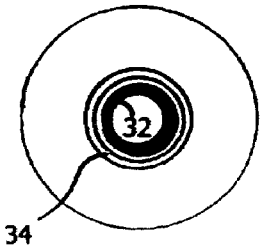
Figure 3C:
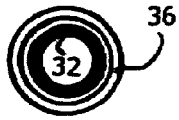

FIG. 3A shows a tension tube 32 portion of the tension mechanism, that connects to the adjustable belt strap transport assembly, or alternatively to the clip-on bar transport assembly, and to the dowel system via elasticized pulley systems. The tension mechanism comprises a hollow tension tube 32, with anchor ports 16 at each end. The tension tube 32 has foam rollers 34 that are mounted on tubular foundations, fitting over and surrounding the exterior circumference of the tension tube. The rollers fit loosely enough over the tension tube to roll easily. Short tubular tension tube spacers 36 also surround the tension tube circumference and occur at each end, in between each foam roller 34, with a longer spacer 36 centered between the two sets of foam rollers 34 at either end. The inner structure and size relationship of the tension tube and rollers are shown in FIG. 3B. The sponge rollers 34 modify the flow of drag and tension on the paper towel roll. The inner structure and size relationship of the tension tube and spacers are shown in FIG. 3C.

Figure 4A:
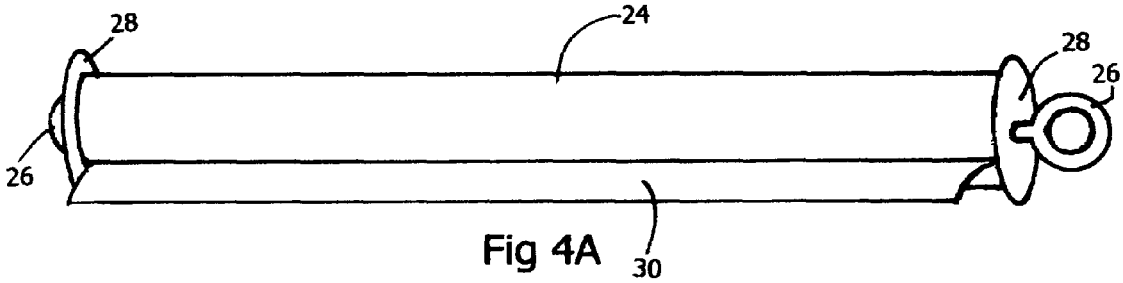
FIGS. 4A to 4B show various aspects and components of a basic dowel system, its construction and parts.
Figure 4B:
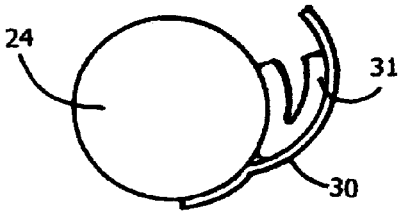

The dowel system as shown in FIG. 4A comprises a dowel 24, with an attached flexible flange 30 that runs the length of the dowel and functions as girth adjuster. At each end of the dowel, resides an attached lip 28 that stabilizes a roll of paper towels on the dowel 24, and an attached eye aperture 26 that receives the bolt snap 38 that is attached to an adjustable pulley system that connects the dowel system to the adjustable belt transport assembly or alternatively to the clip-on bar transport assembly. The dowel system connects to the tension mechanism via a second (lower) pulley system that simultaneously threads through the bolt snap 38 that releasably connects to the dowel eye aperture 26. FIG. 4B shows the construction of the dowel flange. The dowel flange 30 (or equivalent) is connected to the length of the dowel 24. The attached flange 30 (or equivalent) comprises a flexible strip having a foam flange liner 31 comprising a folded or solid piece of foam placed behind or underneath the flange, directly between the flange 30 and the dowel 24 as a means for enhancing the girth adjustment and pressure exerted upon the core of the roll of paper towels. An interior view of the dowel flange 30 construction is shown in FIG. 4B.

The three pulley systems are shown and described as follows: The upper pulley systems both attach to the transport assembly (either the adjustable belt transport assembly or the clip-on bar transport assembly).

Figure 5A:
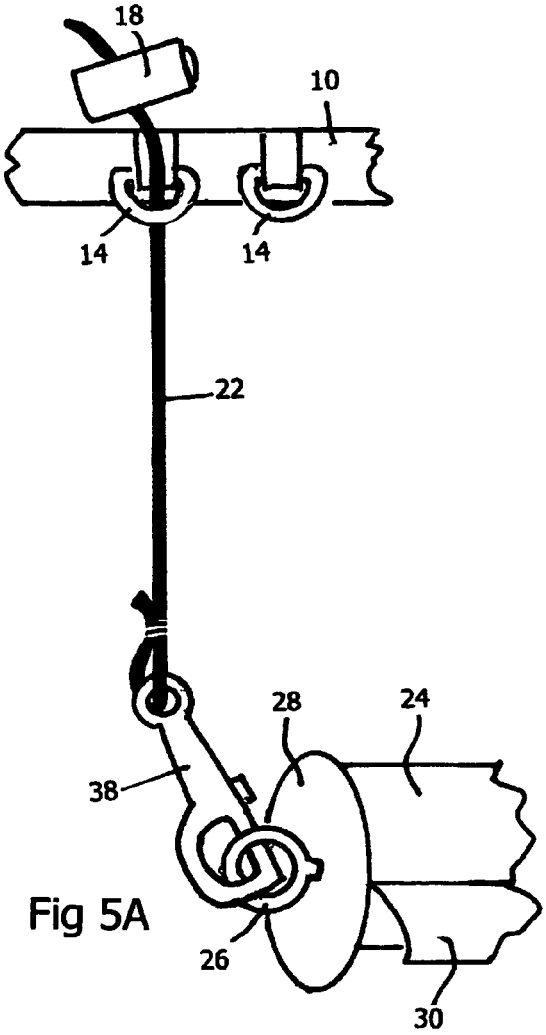
FIGS. 5A to 5C show components and construction of the three pulley systems that interconnect the transport assemblies, tension mechanism and dowel system.

The first, outer pulley system is attached to the top aperture of the bolt snap 38, that is releasably connected to the dowel system, and runs up to the belt strap transport assembly where it threads through a D-ring 14 (or comparable anchor port 16) and is secured with an adjustable cord lock 18 as a means to raise or lower the dowel system. FIG. 5A shows the pulley system consisting of a length of pulley cord 22, a D-ring 14, (or equivalent anchor port 16) and a cord lock 18. The lower end of cord threads through the upper aperture of a bolt snap 38 (or equivalent fastener which realeasably attaches to the dowel eye aperture 22) where the end of the pulley cord 22 is crimped or otherwise secured to the bolt snap 38. The cord runs up to the belt strap transport assembly where it threads through the D-ring 14 (or an equivalent anchor port 16) and is secured with an adjustable cord lock 18. The pulley system operates in the same manner as above when connected to a clip-on bar transport assembly.

Figure 5B:
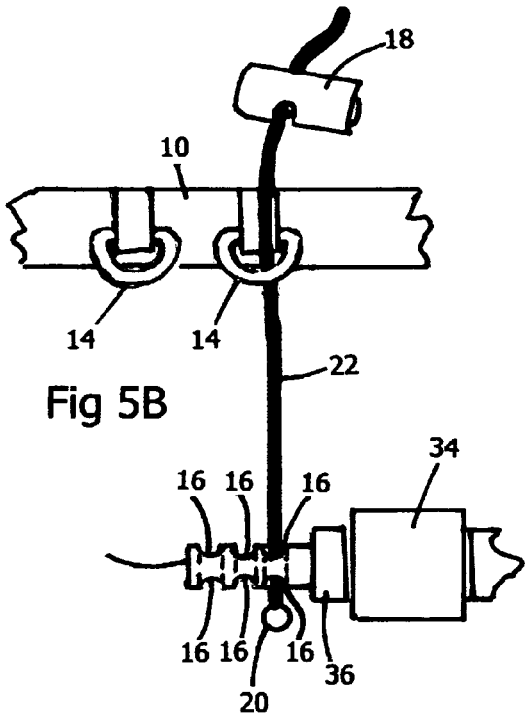

The second, or inner pulley system anchors to the tension tube and runs up to the transport assembly where it is secured with an adjustable cord lock 18 as a means to raise or lower the tension tube. FIG. 5B shows the pulley system consisting of a length of elasticized pulley cord 22, with a built-in cord anchor 20, and a cord lock 18. The bottom end of the pulley cord 22 having a cord anchor 20 is threaded through anchor ports 16 on the tension tube 32 where it runs upwards to a D-ring 14 (or an equivalent anchor port 16) on the belt strap transport assembly where it threads through the D-ring 14 (or equivalent anchor port 16 on a clip-on transport assembly) and is secured with an adjustable cord lock 18. The pulley system operates in the same manner as above when connected to a clip-on transport assembly.

Figure 5C:
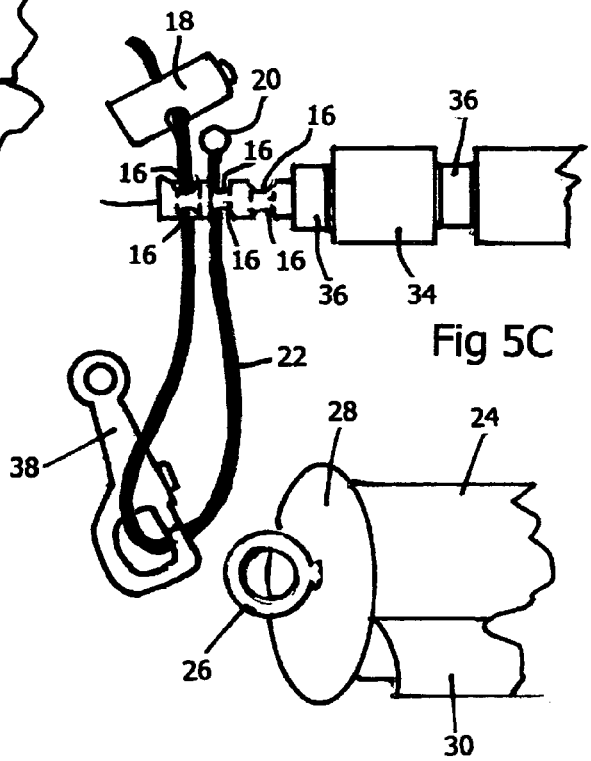

A lower pulley system is anchored to the tension tube 32 where it runs down and threads through the bolt snap 38 whereby it is releasably attached to the dowel system then back up where it threads through the tension tube 32 and is secured to the tension tube 32 with an adjustable cord lock 18 that functions as a means to control the tension between the tension tube and the dowel system which bears a roll of paper towels. FIG. 5C shows the pulley system consisting of a length of elasticized pulley cord 22 with a built-in cord anchor 20 and a cord lock 18. The upper end of pulley cord 22 having a cord anchor 20 is threaded through anchor ports 16 located on the tension tube 32 and then runs downward where it threads through the lower portion of the bolt snap 38 (the same opening that releasably connects to the dowel eye aperture 26) and back up to the tension tube where it threads back through anchor ports 16 and is secured with an adjustable cord lock 18. This pulley system allows for independent adjustment of the left side and of the right side of the tension tube, controlling the number of rollers which make direct contact with the roll of paper towels.

OPERATIONAL—FIGS. 6A TO 6D

The manner of using the transportable paper towel dispenser is similar to stationary paper towel dispensers, in that one simply tears off a desired length of perforated paper towels. However my Transportable Paper Towel Dispenser is carried on the person of the user. No wasted motion walking back and forth from a wall mounted paper towel source. With my transportable paper towel dispenser, one simply reaches down with the hand to tear off the desired amount of towels with one hand.

Figure 6A:
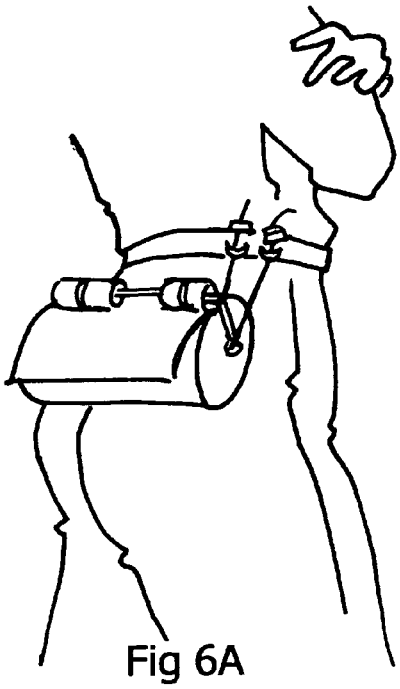
FIGS. 6A to 6D show various ways the device may be worn and used.
Figure 6B:
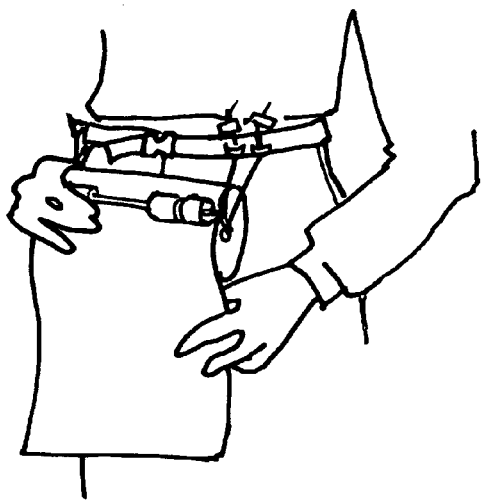
Figure 6C:
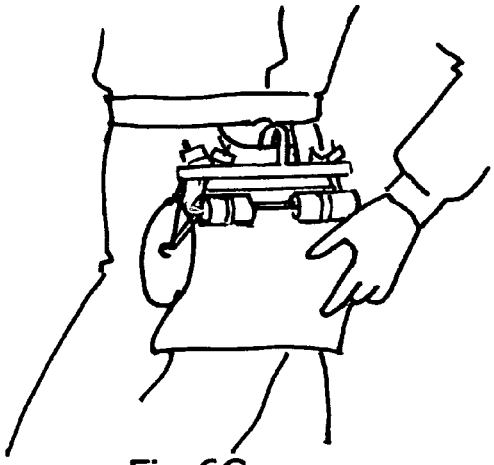
Figure 6D:
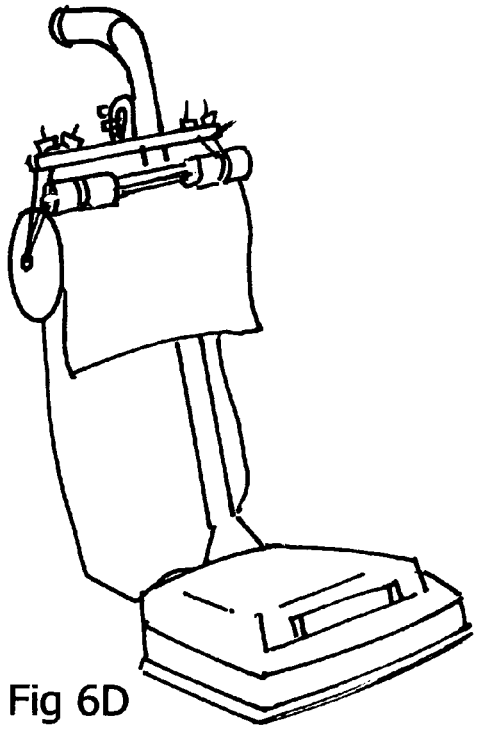

When not in use, the belt strap transport assembly is worn in back as seen in FIG. 6A. To move the belt to the front as seen in FIG. 6B, or to the side, one simply slides the belt strap assembly around to the position desired. The adjustable belt strap assembly is best worn loosely between the waist and the hip for easy maneuvering. When in use, the paper towels are best placed in front or back, or to either side. Or when using the optional clip-on bar transport assembly, one may simply clip it to the users personal belt, a pocket as seen in FIG. 6C. FIG. 6D shows how the clip-on bar transport assembly can be clipped on to surrounding furnishings or other tools such as a vacuum cleaner. To refill the transport with a new roll of towels, one unclips the dowel eye aperture 26 from the bolt snap 38 and lower pulley system at either end of the tension mechanism.

CONCLUSION, RAMIFICATIONS AND SCOPE

Accordingly, the reader will see that the new and improved Transportable Paper Towel Dispenser is an efficient tool for professional cleaning persons, car detailers, painters etc. But it is a convenience and time saver for the average homemaker as well. Furthermore, the Transportable Paper Towel Dispenser has the additional advantages in that:

- it permits the roll of paper towels to be transported to a cleaning area, carried of the person of the user, freeing the hands for other tasks.
- it permits immediate access to a roll of paper towels.
- it permits constant awareness and control of the whereabouts of a roll of paper towels.
- it permits the user to switch to other tasks without removing the device.

Although the description above contains many specifications, these should not be construed as limiting the scope of the invention, but as merely providing illustrations of some of the presently preferred embodiments of this invention. For example; the strap assembly may be made of cord, webbing, rope or an equivalent. And all hardware such as buckles, cords, locks d-rings, anchors or anchor ports described above may easily be changed to any equivalent appropriate to the function of the part.

And the bar clip may be worn several ways on the person depending on the needs and the comfort of the wearer. Or it can be clipped to a vacuum cleaner, cleaning cart or any furnishings convenient to the user.

The tension mechanism is open to further improvement or modification. Or even possible automation. For example, the tension bar could conceivably be controlled by a spring-loaded pull.

And the dowel system may modified in several ways. The present dowel is designed to adapt to the girth of any manufacturer's roll of paper towels which does vary from brand to brand. In addition, there is a likelihood, that a manufacturer could conceivably develop a built-in disposable dowel or equivalent right into a roll of paper towels. Thus the paper towel roll will be specifically designed with end eye apertures that can be connected to and used with my Transportable Paper Towel Dispenser transport assembly and tension mechanism.

Thus the scope of the invention should be determined by the claims and their legal equivalents, rather than the examples given.

I claim:

1. A transportable paper towel dispenser comprising a transport assembly and a tension mechanism, fitted with rollers, connecting to said transport assembly in such a way as to allow free movement of the rollers and a dowel system connecting to said tension mechanism via a pulley system comprised of adjustable connecters that provide tension between the dowel system and the tension mechanism, said dowel system adapted for bearing a roll of paper towels thereon.

2. The transportable paper towel dispenser of claim 1 wherein said transport assembly comprises an adjustable belt.

3. The transportable paper towel dispenser of claim 1 wherein said transport assembly alternatively comprises a clip-on bar.

4. The transportable paper towel dispenser of claim 1 wherein said tension mechanism comprises a tension tube having the rollers fitted thereto and anchor ports whereby a second pulley system comprised of adjustable connecters connects said tension mechanism to said transport assembly and said dowel system as a means to control tension exerted onto said roll of paper towels.

5. The transportable paper towel dispenser of claim 1 wherein said dowel system comprises a dowel to bear a roll of paper towels thereon and having a flexible flange running the length of the dowel, lips and eye apertures on either end whereby a further pulley system comprised of adjustable connecters connect said dowel to said transport assembly and said tension mechanism to said transport assembly as a means to position and adjust pressure exerted upon said roll of paper towels.

6. The transportable paper towel dispenser of claim 1 wherein said dowel system is connected to said transport assembly and said tension mechanism is connected to said transport assembly by a further pulley system comprised of adjustable connecters said pulley systems comprising lengths of pulley cord, built-in cord anchors, anchor ports, and cord locks whereby said pulley systems are a means of interconnecting, unifying and manipulating said transport assembly, said tension mechanism, and said dowel system.

7. The transportable paper towel dispenser of claim 1 wherein said paper towel roll is replaced by unsnapping fasteners on the dowel system such that the dowel system is detached from said tension mechanism and said transport assembly simultaneously.

* * * * *